US005454478A

United States Patent [19]

Everson

[11] Patent Number: 5,454,478

[45] Date of Patent: Oct. 3, 1995

[54] COMPARTMENTALIZED TRANSPORT CONTAINER

[76] Inventor: Thomas J. Everson, 12418 C St., Omaha, Nebr. 68144

[21] Appl. No.: 378,510

[22] Filed: Jan. 26, 1995

[51] Int. Cl.[6] ..... B65D 1/36

[52] U.S. Cl. ..... 220/23.83; 220/528

[58] Field of Search ..... 220/23.83, 23.86, 220/408, 527, 528; 206/564

[56] References Cited

U.S. PATENT DOCUMENTS

| | | | |
|---|---|---|---|
| 2,198,459 | 4/1940 | Potts | 206/72 |
| 2,296,738 | 9/1942 | Quiggle et al. | 220/22 |
| 2,469,856 | 5/1949 | Robertson | 220/20 |
| 2,944,694 | 7/1960 | Kinsey | 220/408 X |
| 3,589,554 | 6/1971 | Smith | 220/17 |
| 4,591,056 | 5/1986 | Groch | 206/564 |
| 4,830,190 | 5/1989 | Inagaki | 206/550 |
| 4,834,253 | 5/1989 | Crine | 220/23.83 X |
| 4,838,445 | 6/1989 | Lanius | 220/22.3 |
| 4,884,689 | 12/1989 | Su-Chin | 206/372 |
| 5,011,018 | 4/1991 | Keffeler | 220/528 X |
| 5,050,755 | 9/1991 | Strawder | 220/23.83 X |
| 5,054,668 | 10/1991 | Ricchiuti | 220/528 X |

*Primary Examiner*—Steven M. Pollard

*Attorney, Agent, or Firm*—John A. Beehner

[57] ABSTRACT

A compartmentalized transport container includes a generally rectangular transport box and lid, the box having two side walls, front and rear walls and a base wall, each of the walls connected along edges thereof such that an open-topped box is formed having outer and inner surfaces. A plurality of generally upright box ribs are formed on at least two of the side walls and front and rear walls on the inner surface of the box, the box ribs extending generally perpendicular to the base wall of the box. For insertion into the transport box, at least one generally rectangular storage compartment is provided having two side walls, front and rear walls and a base wall, the side walls, front and rear walls and base wall connected along edges thereof such that the generally rectangular storage compartment is formed having outer and inner surfaces and being of a size and shape to fit within the transport box. Each storage compartment includes a plurality of generally upright compartment ribs formed on at least two of the side walls and front and rear walls on the outer surface thereof and extending generally perpendicular to the base wall of the storage compartment. The compartment ribs interfit with the box ribs such that the transport box slidably receives the storage compartment in a set position within the transport box. The storage compartment is restricted from substantial movement parallel with the box base wall due to the compartment ribs interfitting with the box ribs.

11 Claims, 9 Drawing Sheets

COMPARTMENTALIZED TRANSPORT CONTAINER

BACKGROUND OF THE INVENTION

1. Technical Field

This invention relates to transport containers, and, more particularly, to a compartmentalized transport container which includes a generally rectangular box having a plurality of upright ribs on the interior walls thereof and at least one generally rectangular compartment having upright ribs on the outer walls thereof, the box ribs and compartment ribs interfitting such that the box slidably receives the compartment in a set position within the box and prevents lateral movement of the compartment within the box.

2. Description of the Prior Art

Safe and secure shipment of materials via air transport is a driving force behind the development of transport containers. The rough handling of baggage by airport personnel is a universal problem. Various types of containers are presently used for shipping purposes, such as styrofoam, plastic or corrugated cardboard boxes and the like. However, when materials are shipped in such boxes, the materials are free to move around within the box, so that even if the box is undamaged by shipping, the materials within the box may be damaged by shifting of those materials. There is therefore a need for a transport container which will prevent substantial lateral shifting of the contents of the container.

Various examples have been proposed in the prior art which attempt to solve this problem. For example, Lanius, U.S. Pat. No. 4,838,445, discloses a container including variable position compartment dividers, Su-Chin, U.S. Pat. No. 4,884,689, discloses a flexible briefcase accessories compartment assembly structure and Quiggle et al., U.S. Pat. No. 2,296,738, discloses a cooler spacer which secures bottles within a cooler. However, each of these devices is limited in the amount of protection which the device supplies to contents of the compartment. Also, very large or very small objects cannot be properly retained to prevent shifting within any of the above-described prior art devices.

The deficiencies in prior art devices are particularly apparent in situations where materials such as training or educational materials, including printed documents, framed transparencies, markers, pens, pencils and other such materials are to be shipped to various locations. It is often found that shipping of such materials in presently available shipping containers may result in the training materials being unusable after shipment. It is often necessary to ship such materials in relatively expensive custom shipping containers which have a usable life span of only a few months. It thus becomes very difficult to ship training materials to various locations around the world in anticipation of training sessions at the shipped-to location. There is therefore a need for a transport container which will safely and easily accommodate such training materials, retaining the training materials in such a manner that substantially no damage is done to the materials within the container.

Also, there is a need for a transport container which will safely ship a variety of materials through the mail. Various mailing containers have been proposed in the prior art, including standard rectangular box plastic containers and the like. However, none of the prior art devices so far suggested provide a system by which the contents of the container are prevented from substantially shifting within the container while the container is being mailed. There is therefore a need for a transport container which will accommodate and restrain a variety of materials for mailing purposes.

Therefore, an object of the present invention is to provide an improved compartmentalized transport container.

Another object of the present invention is to provide a compartmentalized transport container including a generally rectangular open-topped transport box having a plurality of upright box ribs formed on the inner upright surfaces of the transport box, and at least one generally rectangular storage compartment of a size and shape to fit within the transport box, the storage compartment including a plurality of upright compartment ribs on the outer surface thereof, the box ribs and compartment ribs interfitting such that the transport box slidably receives the storage compartment and restricts substantial movement of the storage compartment parallel with the base of the transport box.

Another object of the present invention is to provide a compartmentalized transport container which accommodates various sized storage compartments to allow for transport of various sized items without shifting of those items.

Another object of the present invention is to provide a compartmentalized transport container which is constructed of breakage-resistant plastic or the like to provide a sturdy and lightweight transport container.

Another object of the present invention is to provide a compartmentalized transport container which includes a lockable top lid, one or more handles and wheels on the bottom thereof which combine to produce an easily transportable transport container for use in a variety of situations.

Finally, an object of the present invention is to provide a compartmentalized transport container which is simple and inexpensive in construction and safe and efficient in use.

SUMMARY OF THE INVENTION

The present invention provides a compartmentized transport container including a generally rectangular transport box having two side walls, front and rear walls and a base wall, the side walls, the front and rear walls and the base wall connected along edges thereof such that an open-topped transport box is formed having outer and inner surfaces. A plurality of box ribs are formed on at least two of the side walls and front and rear walls on the inner surface of the box, the box ribs extending generally upright perpendicular to the base wall of the box. At least one generally rectangular storage compartment having two side walls, front and rear walls and a base wall is also included, the side walls, front and rear walls and base wall connected along edges thereof such that the generally rectangular storage compartment is formed having outer and inner surfaces, the storage compartment being of a size and shape to fit within the transport box. The storage compartment includes a plurality of generally upright compartment ribs on at least two of the side walls and front and rear walls of the outer surface of the storage compartment, the compartment ribs extending generally perpendicular to the base wall of the storage compartment. Finally, the compartment ribs interfit with the box ribs such that the transport box slidably receives the storage compartment in a set position within the transport box, the storage compartment being restricted from substantial movement parallel to the box base wall due to the compartment ribs interfitting with the box ribs.

The present invention may also include storage compartments having a variety of shapes and sizes, such as tall vertical insert sleeve compartments or shallow horizontal compartments, or horizontal compartments including a plurality of small drawers. Movement of any storage compartment within the transport box is restricted by interfitting of the compartment ribs and box ribs, as discussed above.

The present invention thus provides a substantial improvement over those devices found in the prior art. For example, the interfitting ribs of the box and compartments allow the storage compartments to be securely held within the transport box and restricted from substantial movement parallel to the box base wall. Also, because a number of different sized compartments may be used within the box, a combination of materials may be transported in the same box without worrying about damaging any of the contents due to shifting of the contents. Furthermore, because the compartmented transport container of the present invention is constructed of impact-resistant plastic, damage to the container during shipping and/or mailing is limited, thus insuring an extended service life. Therefore, it is seen that the present invention provides substantial improvement over those devices found in the prior art.

DESCRIPTION OF THE PREFERRED EMBODIMENT

Figure 1:
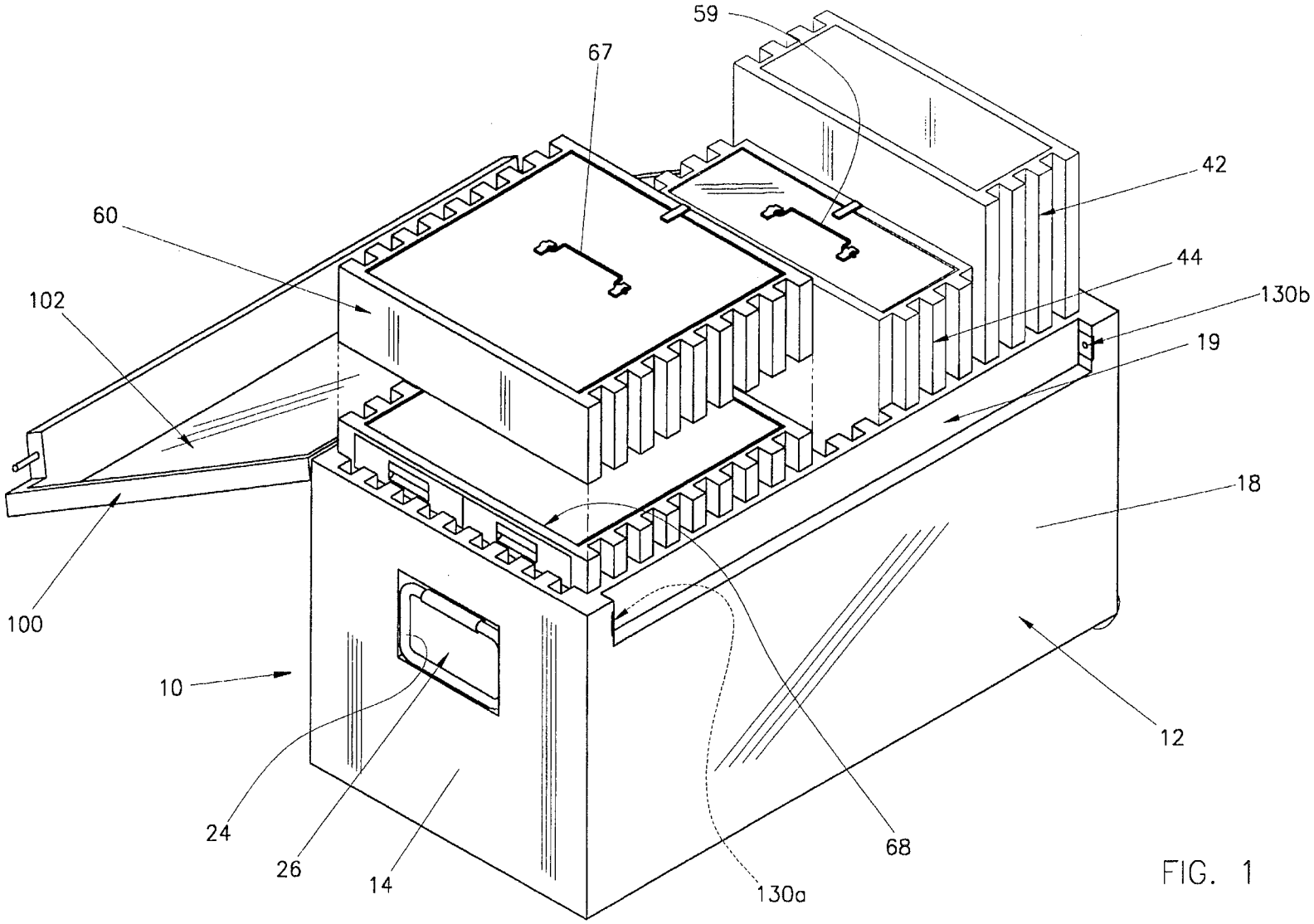
FIG. 1 is a perspective view of the compartmentalized transport container of the present invention showing the various compartments stacked within the container.

The compartmented transport container 10 of the present invention is shown best in FIGS. 1–5 as including a transport box 12 which includes left and right sidewalls 14 and 16, front wall 18, rear wall 20 and base wall 22. The generally rectangular shape of the transport box 12 is thus formed. It is preferred that transport box 12 have internal dimensions of approximately 30 inches in width, 15 inches in height and 10 inches in depth, resulting in external dimensions of approximately 32 inches in width, 16 inches in height and 12 inches in depth. In this disclosure, the width dimension is to be understood to refer to dimensions orthogonal to left and right side walls 14 and 16, the height dimension referring to dimensions orthogonal to base wall 22 and the depth dimension referring to dimensions orthogonal to front and rear walls 18 and 20. Of course, these dimensions are only examples of preferred dimensions and it is to be understood that numerous changes may be made to the size of the transport box 12 depending upon the materials to be transported.

It is preferred that transport box 12 be constructed of a generally lightweight rigid plastic such as polyvinyl chloride or the like. Such a construction material would allow the transport box 12 to have an extended serviceable lifetime, to be easily transported due to the light weight of the box 12 and allow for safe and secure transport of materials within transport box 12.

One or more handles 24 may be affixed to the outer surface of left and right side walls 14 and 16, as shown in FIG. 1. It is preferred that the handles 24 be recessed and spring biased such that each handle 24 is releasably retained within handle cavity 26.

Figure 4:
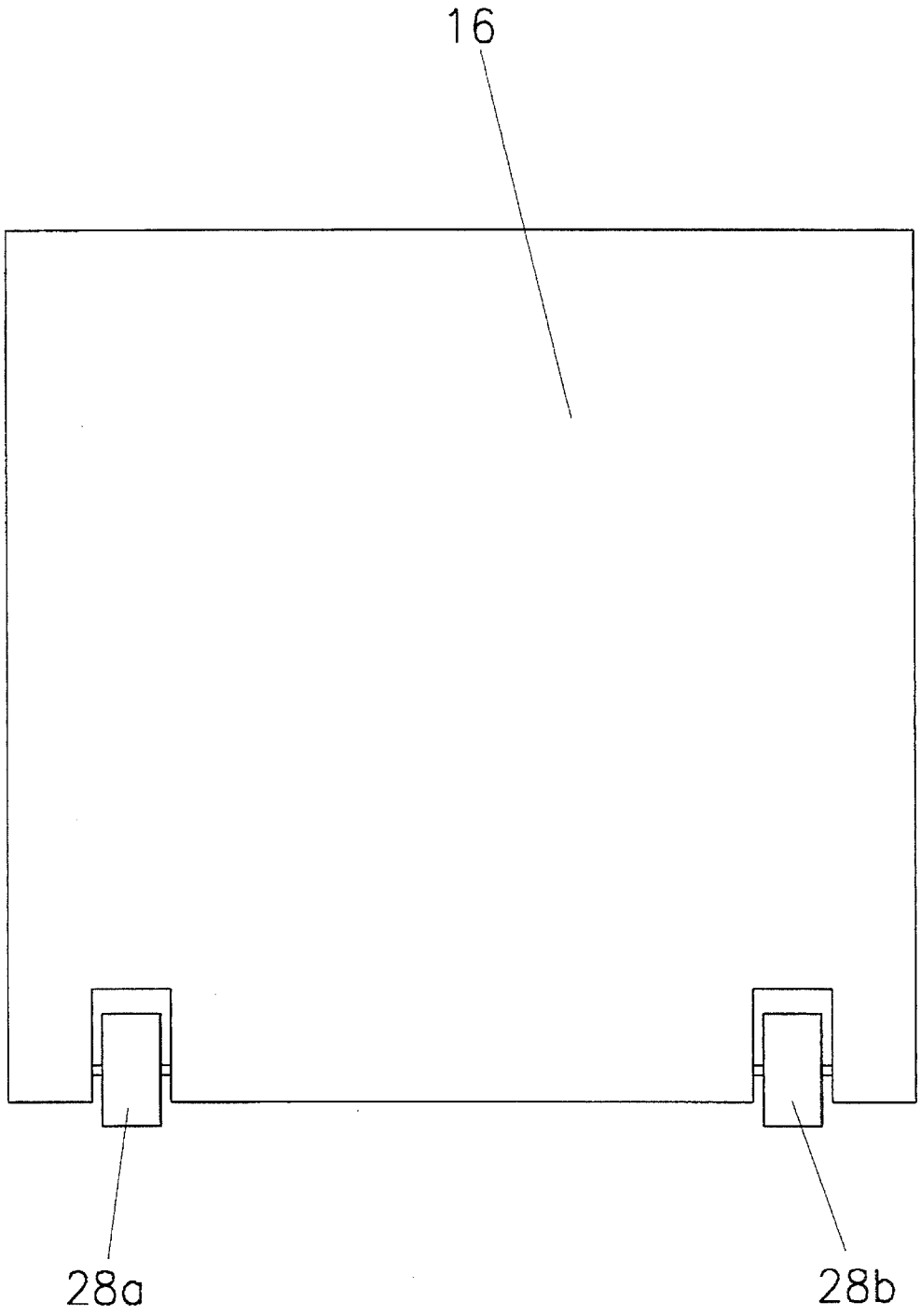
FIG. 4 is a rear elevational view of the transport box showing the wheels on the backside thereof.

Base wall 22 may also include wheels **28*a* and 28*b* recessed within base wall 22 as shown in FIG. 4. It is preferred that wheels 28*a* and 28*b*** be standard luggage-type wheels, although a variety of wheel types may be employed with the present invention.

Figure 2:
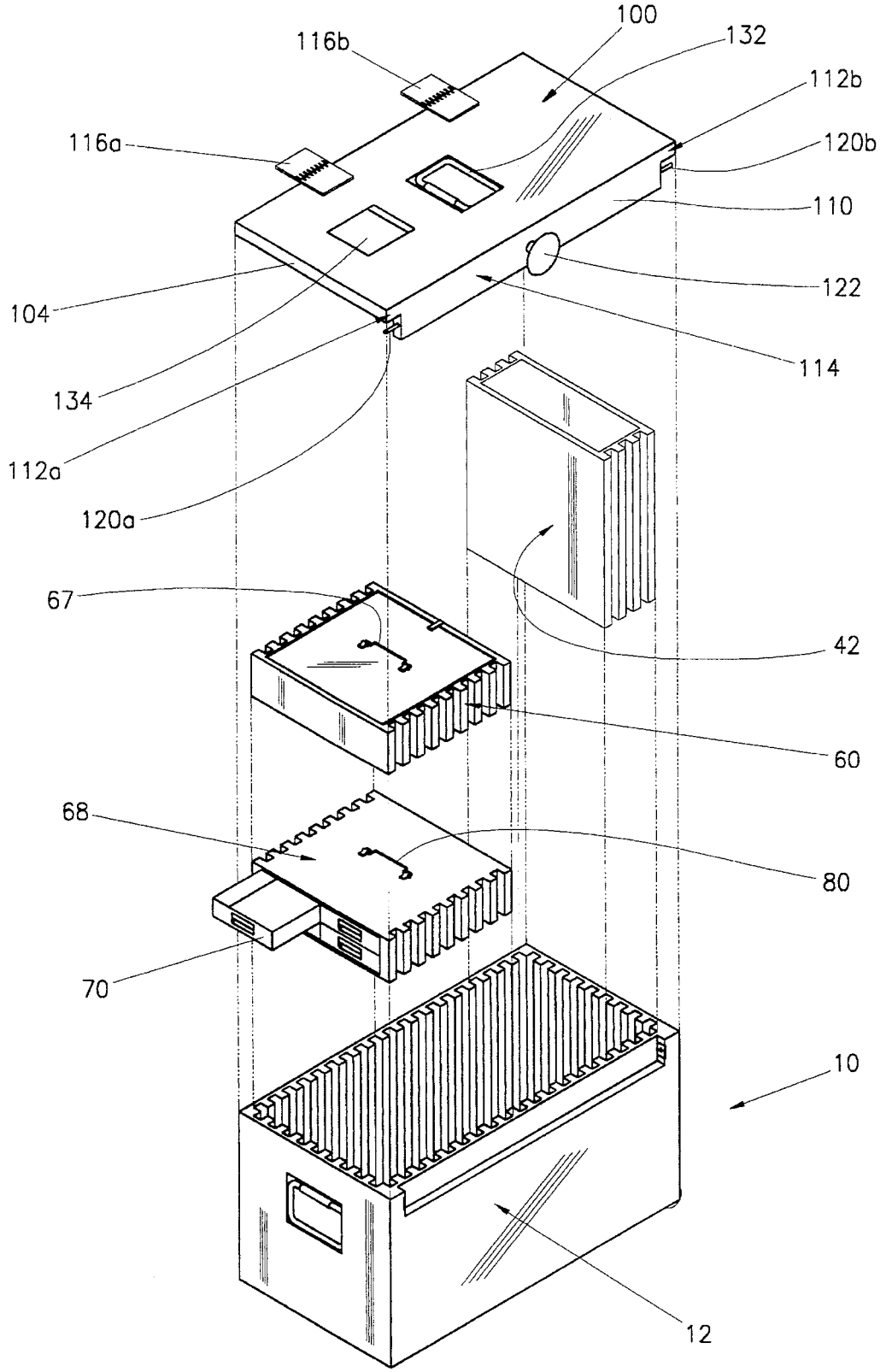
FIG. 2 is an exploded perspective view of the present invention showing the various compartments and elements of the transport container.
Figure 3:
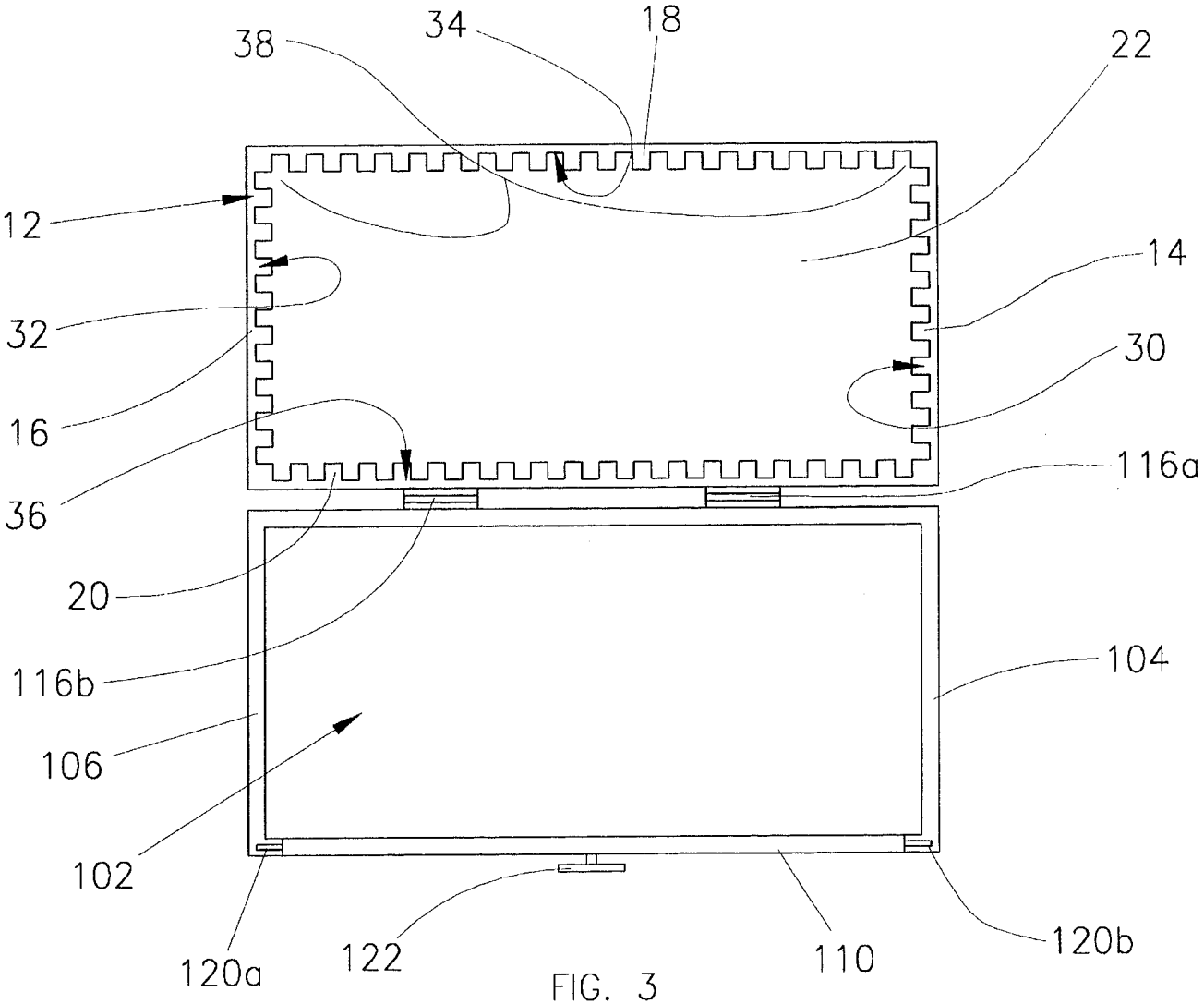
FIG. 3 is a top plan view of the transport box without any compartments therein.

The inner surfaces 30, 32, 34 and 36 of left and right side walls 14 and 16, front wall 18 and rear wall 20, respectively, are best shown in FIGS. 1–3 as including a plurality of box ribs 38 which in the preferred embodiment are alternating grooves and ridges having a generally rectangular cross-sectional shape. It is preferred that box ribs 38 extend the entire height of each of the left and right side walls 14 and 16, front wall 18 and rear wall 20, as shown in FIGS. 1 and 3. In a preferred embodiment, each of the box ribs 38 preferably has a width of approximately one-half (½) inch, although the exact width of the box ribs 38 is not critical so long as at least some of the box ribs are substantially uniformly spaced. Additionally, while the present invention is shown in the preferred embodiment as including box ribs 38 on all inner surfaces 30, 32, 34 and 36 of left and right side walls 14 and 16 and front and rear walls 18 and 20, it is to be understood that box ribs 38 need only be formed on opposite wall structures, such as left and right side walls 14 and 16 or front and rear walls 18 and 20.

Box ribs 38 may be formed on the various wall structures of the transport box 12 using any appropriate method, such as vacuum molding or plastic cutting. However, it is preferred that transport box 12 be formed as an integral unit using vacuum molding techniques, in which a mold is prepared including box ribs 38 and left and right side walls 14 and 16, front and rear walls 18 and 20 and base wall 22, with the molten plastic being poured into the mold and being vacuum formed to the walls of the mold to form transport box 12.

For releasably closing transport box 12, a box lid 100 is hingedly attached to transport box 12, as shown in FIG. 1–3. Box lid 100 preferably has the same width and depth dimensions as transport box 12 and preferably is shaped to resemble a shallow rectangular tray which includes a top wall 101 and central depression 102, shown best in FIG. 1–3. It is preferred that left and right side walls 104 and 106 and rear wall 108 each be of approximately the same height, which is preferably approximately 2 inches. In such an embodiment, depression 102 would have a height of approximately 1 inch to 1¾ inches. Depression 102 allows for items to be placed on top of storage compartments 40 and retained within the transport box 12, such as an umbrella or the like. Box lid 100 also includes a front wall 110 which includes opposite end portions **112*a* and 112*b* approximately the same height as left and right side walls 104 and 106 and a center portion 114 having a height of approximately 3–4 inches. When box lid 100 is closed, therefore, left and right side walls 104 and 106 and rear wall 108 contact and engage top surfaces of left and right side walls 15 and 16 and rear wall 20 of transport box 12, while end portions 112***a* and 112*b* of front wall 110 contact the outer top surfaces of front wall 18 and center portion 114 of front wall 110 extends into a lid cavity 19 formed in front wall 18 of transport box 12. Box lid 100 is secured to transport box 12 by hinges 116*a* and 116*b*, shown best in FIG. 2. It is to be understood, however, that numerous types of hinges may be employed for the present invention as substitutes for the hinges shown in the preferred embodiment.

Figure 6:
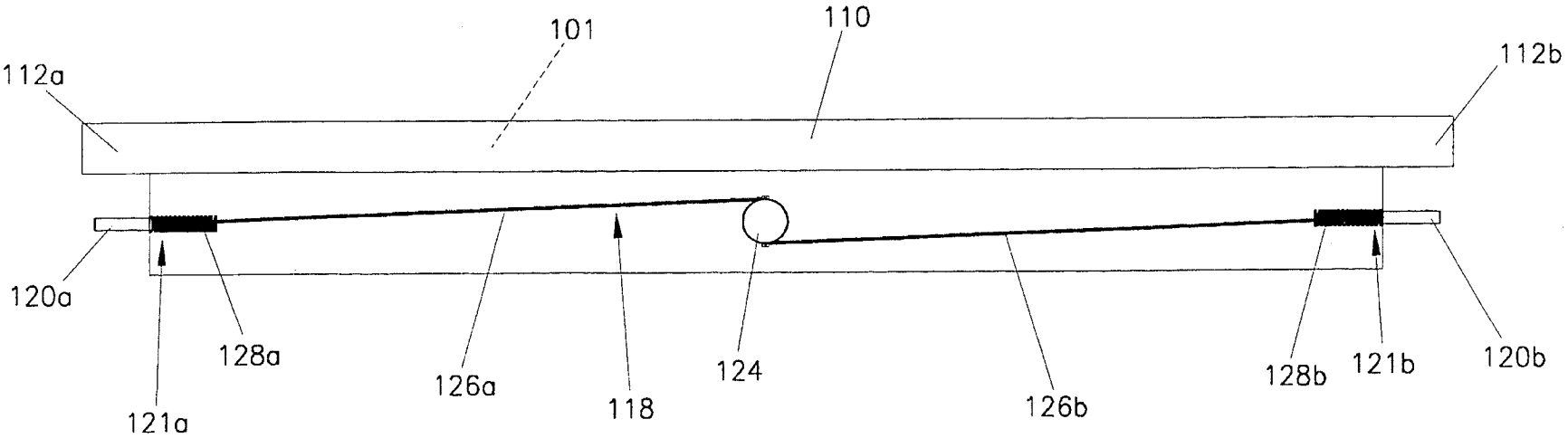
FIG. 6 is a side sectional elevational view of the top lid displaying the locking mechanism for releasably closing the transport box.

A preferred method for securing box lid 100 in a closed position on transport box 12 is shown in FIGS. 1 and 6 as including a pin and hole securement system 118 mounted within center portion 114 of front wall 110. The pin and hole securement system 118 includes a pair of securement pins 120*a* and 120*b* which extend outwards from the center portion 114 generally parallel with the front wall 110 such that securement pins 120*a* and 120*b* underhang end portions 112*a* and 112*b* of front wall 110. It is preferred that securement pins 120*a* and 120*b* each be narrow diameter metal rods, although the exact size, shape or construction material used for securement pins 120*a* and 120*b* is not critical so long as they are sturdy and resistent to breakage. Rotatably mounted and extending outwards from front wall 110 is a knob 122 having a shaft 124 which extends within front wall 110, as shown best in FIG. 6. Each securement pin 120*a* and 120*b* includes an attachment hole 121*a* and 121*b* formed in the inner end of each pin 120*a* and 120*b* and extending transversely therethrough. Extending between shaft 124 and each securement pin 120*a* and 120*b* are cables 126*a* and 126*b* each of which extends tangentially from shaft 124 and extend into and are secured to securement holes 121*a* and 121*b*, respectively. When knob 122 is rotated, shaft 124 likewise rotates thus causing cables 126*a* and 126*b* to wrap around shaft 124, thus sliding securement pins 120*a* and 120*b* towards shaft 124 and thus into center portion 114. For returning the securement pins 220*a* and 120*b* to their initial extended position, a pair of biasing springs 128*a* and 128*b* are connected to respective securement pins 120*a* and 120*b*, as shown in FIG. 6. When knob 122 is rotated, pins 120*a* and 120*b* are drawn towards shaft 124 and biasing springs 128*a* and 128*b* are tensioned. When knob 122 is released, biasing springs 128*a* and 128*b* return securement pins 120*a* and 120*b* to their original extended positions.

When box lid 100 is in closed position, securement pins 120*a* and 120*b* extend into pin-receiving holes 130*a* and 130*b* formed in the side walls of lid cavity 19, as shown in FIG. 1. When securement pins 120*a* and 120*b* are lodged within pin-receiving holes 130*a* and 130*b*, pivotal movement of box lid 100 is prevented, thus securing the contents of transport box 12 within transport box 12.

As is best shown in FIG. 2, box lid 100 would preferably include a recessed handle 132 for carrying compartmentalized transport container 10. Box lid 100 may also include a clear plastic label holder 134 for securement of mailing lists and mailing labels showing the destination or contents of the compartmentalized transport container 10.

Box ribs 38 are designed to releasably secure one or more storage compartments 40 within box 12, as shown in FIG 1. Various types of storage compartments 40 are shown in FIG. 1 with what is believed will be three of the most popular types of storage compartments 40 being exhibited. Vertical compartments 42 and 44 are shown as having a width of approximately 3 to 4 inches and a height and depth approximately equal to the internal height and depth of transport box 12. The only difference between vertical compartments 42 and 44 is that vertical compartment 44 includes a top cover 46 which is hingedly connected to vertical compartment 44 by a living hinge 49 or the like and is designed to close and cover the interior volume of vertical compartment 44. A living hinge is typically a straight section of material which is thinner than surrounding material, thus creating a bending line which acts as a hinge. A pivoting latch 47 may be mounted on vertical compartment 44 for securing top lid 46 in a closed position. It is preferred that vertical compartments 42 and 44 be substantially identical, and therefore the following description with regards to vertical compartment 44 shall be understood to apply in great part to vertical compartment 42.

Figure 5:
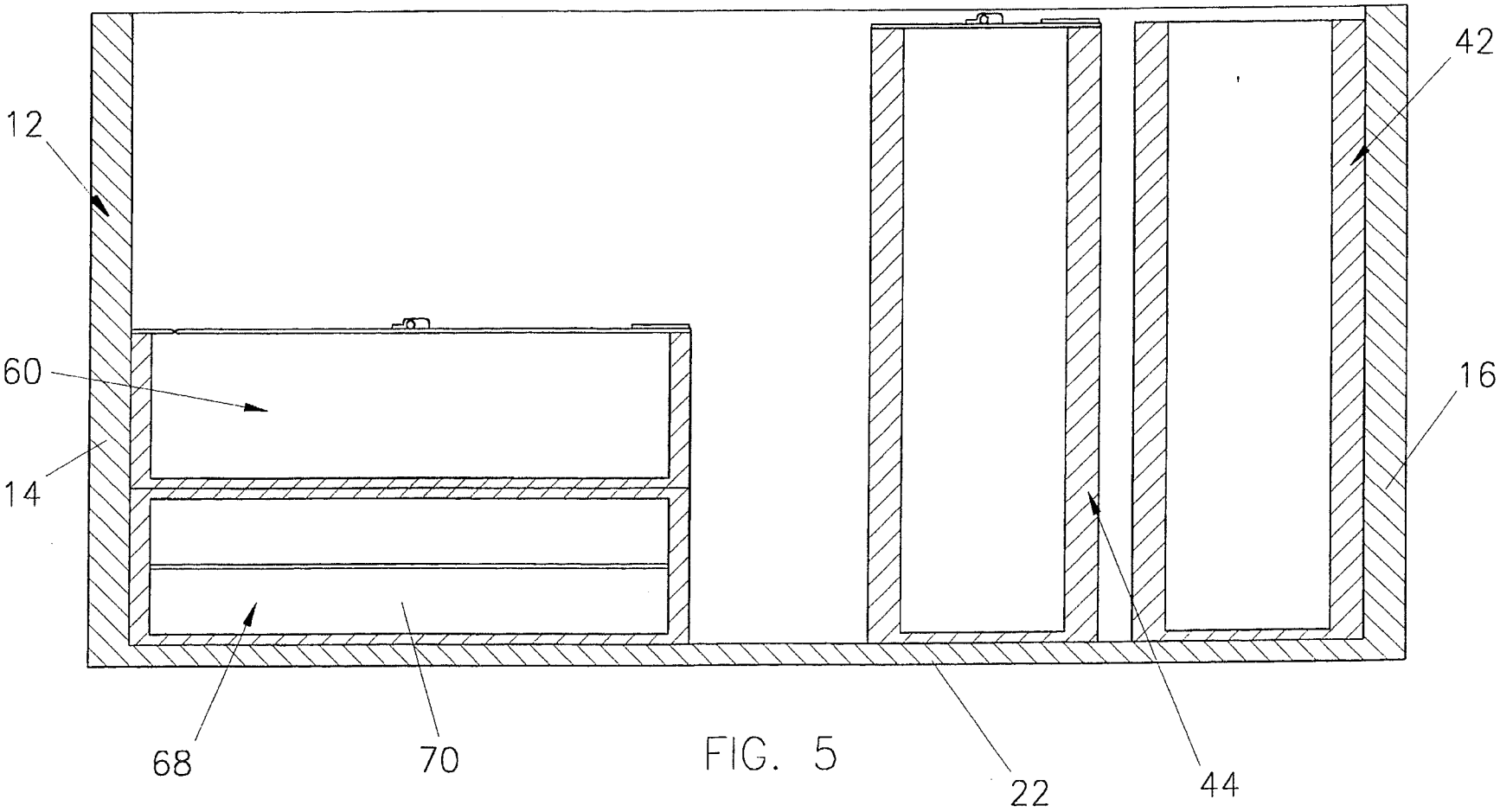
FIG. 5 is a side sectional elevational view of the transport box displaying the compartments therein.
Figure 7:
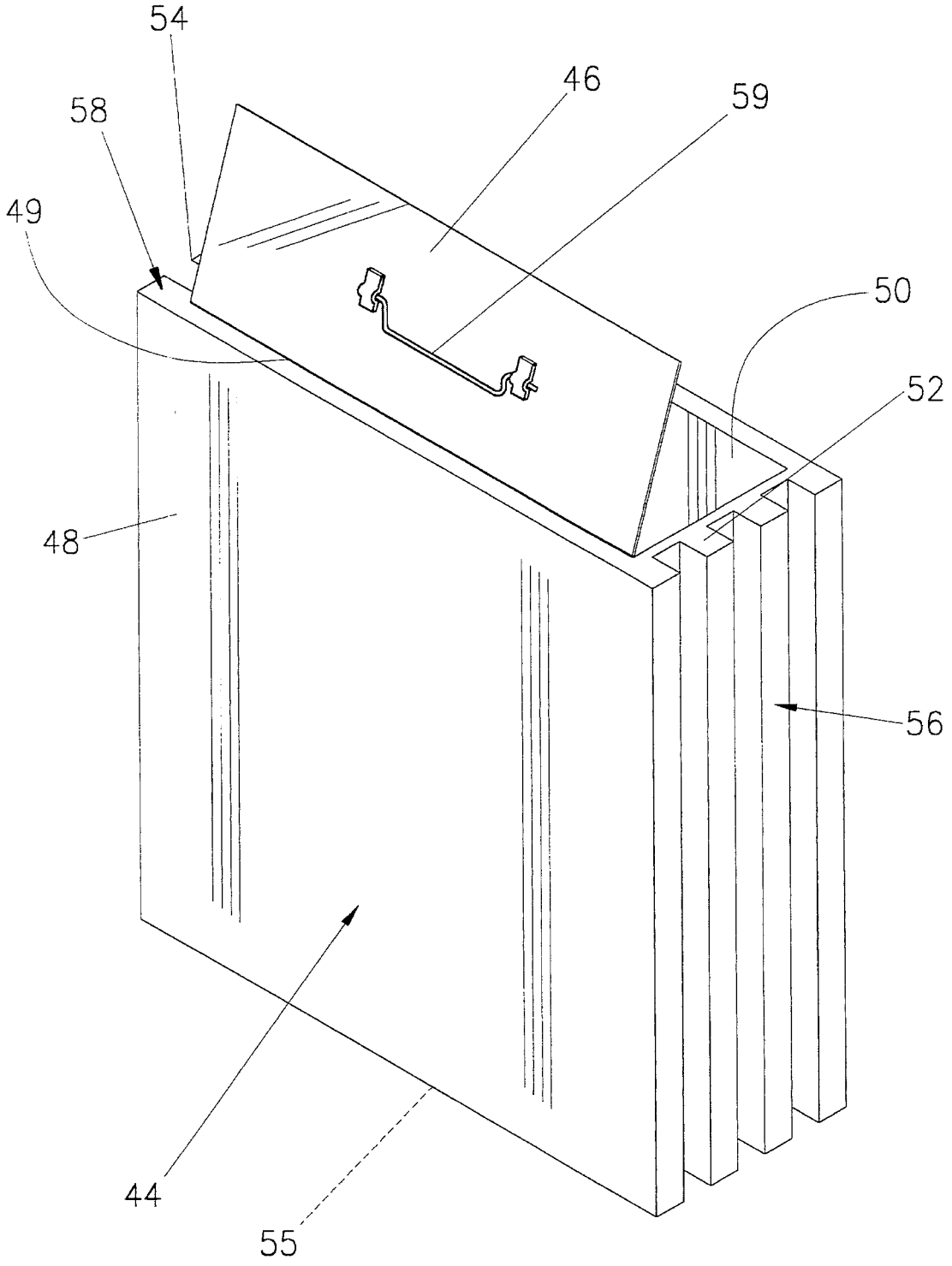
FIG. 7 is a partial detail perspective view of a vertical compartment.

Vertical compartment 44, shown best in FIG. 7, preferably includes left and right side walls 48 and 50, front and rear walls 52 and 54 and a base wall 55. Front and rear walls 52 and 54 each preferably include a plurality of generally upright compartment ribs 56 and 58, respectively, compartment ribs 56 and 58 running substantially parallel with box ribs 38 on inner surfaces 30, 32, 34 and 36 of transport box 12. Compartment ribs 56 and 58 interfit with box ribs 38 on inner surfaces 34 and 36 of front and rear walls 18 and 20, as shown in FIG. 1, thus allowing vertical compartment 44 to be slidably inserted into transport box 12 in a vertical manner. As best shown in FIG. 1, the grooves of ribs 56 and 58 accommodate the ridges of box ribs 38 on inner surfaces 34 and 36, and similarly the ridges of compartment ribs 56 and 58 are accommodated by the grooves of box ribs 38, thus allowing compartment ribs 56 and 58 to interfit with box ribs 38. As vertical compartment 44 has a height approximately equal to the depth of transport box 12, vertical compartment 44 may be slid entirely within transport box 12, as shown in FIGS. 1 and 5. Vertical compartment 44 is thus prevented from moving horizontally in any direction due to the interfitting of compartment ribs 56 and 58 and box ribs 38, and is restricted from vertical motion by the closing of lid 100.

It is to be understood that the width of vertical compartment 44 may be adjusted to securely accommodate narrow reams of paper or the like, so long as front and rear walls 52 and 54 each include at least one compartment rib 56 and 58 to engage box ribs 38 on transport box 12. The dimensions of vertical compartment 44 thus will accommodate even legal-size papers or transparencies while simultaneously preventing significant shifting of the contents of the vertical compartment 44.

Figure 8:
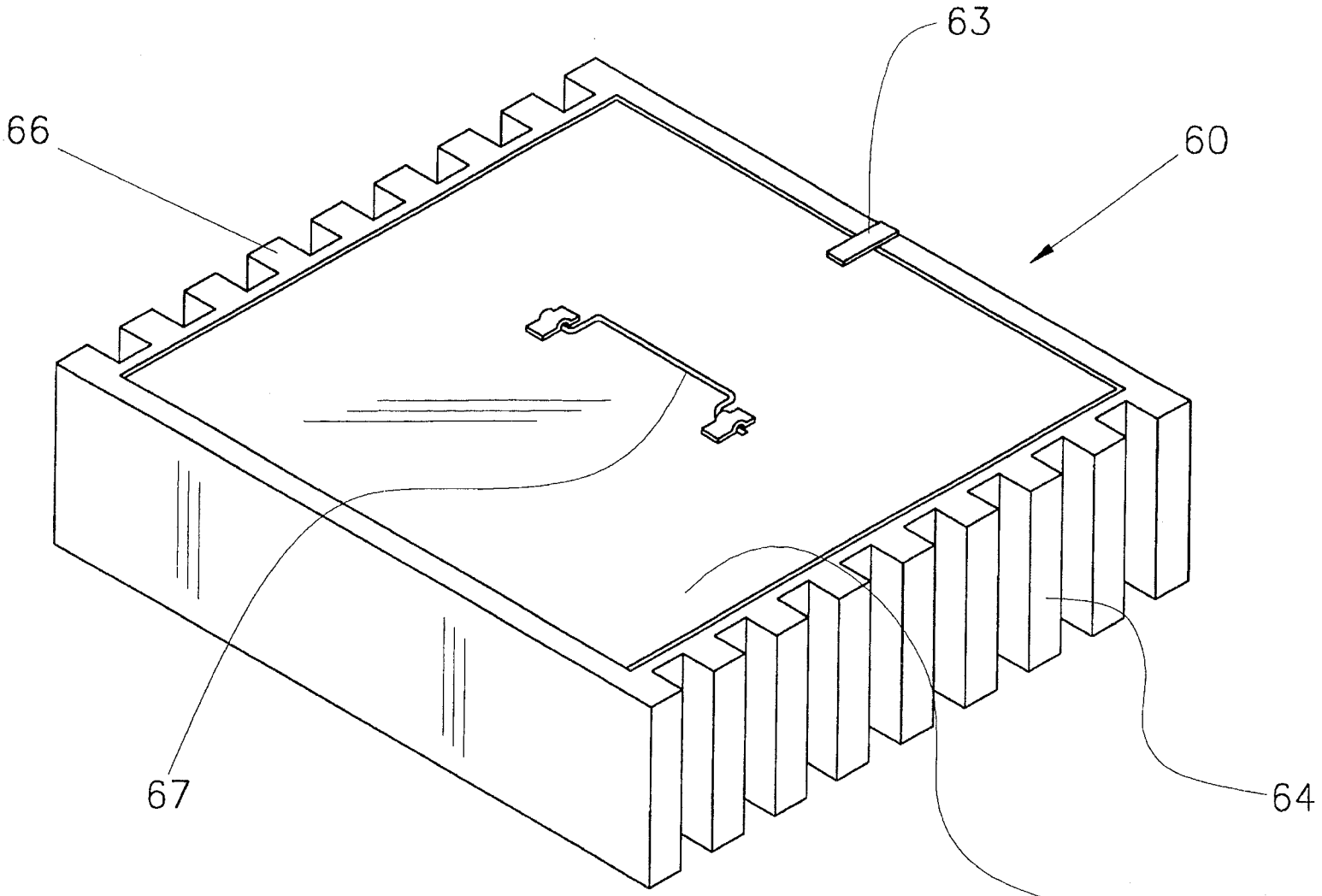
FIG. 8 is a partial detail perspective view of a horizontal compartment.

Shown in FIGS. 1 and 8 is a horizontal compartment 60 having a hingedly connected top cover 62 and latching mechanism 63 as on vertical compartment 44. Horizontal compartment 60 preferably has a width of approximately 12 inches, a height of approximately 2 to 5 inches and a depth approximately equal to the depth of transport box 12, as discussed previously. Horizontal compartment 60 is thus designed to accept and hold standard 8½ inch by 11 inch papers in a secure manner. It is seen that compartment ribs 64 and 66 on opposite sides of horizontal compartment 60 engage box ribs 38 on inner surfaces 34 and 36 of front and rear walls 18 and 20 of transport box 12 in much the same manner as compartment ribs 56 and 58 discussed in connection with vertical compartment 44 above. As shown in FIGS. 1 and 5, the shorter height of horizontal compartment 60 allows a plurality of similar-type compartments to be stacked one atop another to provide for additional storage within transport box 12.

Figure 9:
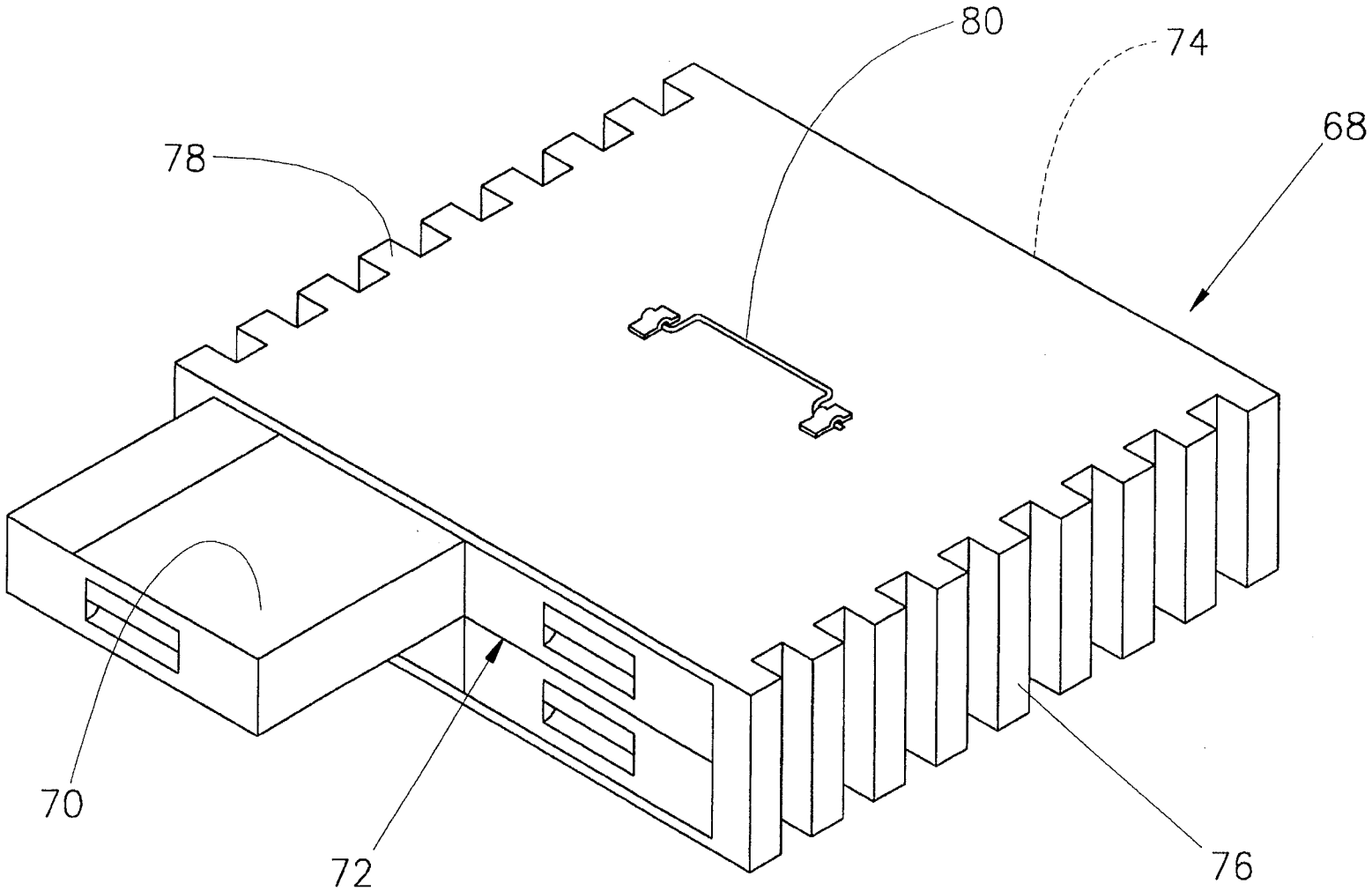
FIG. 9 is a partial detail perspective view of a horizontal compartment with drawers.

The third type of compartment illustrated in the present invention is the horizontal compartment 68 with drawers which includes a plurality of drawers 70 which are slidably retained within horizontal compartment 68, as shown in FIGS. 1 and 9. It is further preferred that the horizontal compartment 68 be generally hollow and accommodate a plurality of drawers 70 which may be opened on either the left or right side walls 72 and 74 of horizontal compartment 68. Horizontal compartment 68 would preferably have similar dimensions to horizontal compartment 60 and thus drawers 70 would preferably have dimensions of approximately 12 inches in width, 4 inches in depth and 2 inches in height, using the conventions outlined previously. Drawers 70 are specifically designed to hold such items as pens, pencils, rulers and other such small items. The relatively small size of the drawers 70 allows such items to be securely retained within the drawers 70 permitting minimal movement of the contents of drawers 70, thus protecting those contents.

It is preferred that horizontal compartment 68 be secured within transport box 12 in a manner similar to that described in connection with horizontal compartment 60, specifically that horizontal compartment 68 includes front and rear compartment ribs 76 and 78 which engage box ribs 38 of transport box 12 thus preventing lateral movement of horizontal compartment 68 relative to transport box 12. It is preferred that horizontal compartment 68 be inserted into transport box 12 such that drawers 70 abut left or right side walls 14 and 16 of transport box 12 to prevent the drawers 70 from opening during transport of transport box 12. Alternatively, drawers 70 may include latches (not shown) which secure drawers 70 within horizontal compartment 68.

One further type of horizontal compartment is envisioned for use in the present invention. In this alternative horizontal compartment, the top cover 62 would be removed thus forming a generally open-topped box into which materials may be inserted. The alternative horizontal compartment described herein, however, is specifically designed for use as a container of video cassettes of the VHS kind. It is preferred that the video cassettes would be stored upright with the long end of each video cassette contacting the base wall of the horizontal compartment. In this alternative horizontal compartment, the preferred height dimension would be approximately equal to the height of a single video cassette standing upright on its long end, or approximately 3–5". In this matter, a plurality of video cassettes may be safely stored within the alternative horizontal compartment as described herein.

It is further preferred that the storage compartments 40 be constructed of plastic similar to that used for transport box 12, and that the storage compartments 40 be vacuum formed. Of course many types of construction materials may be used so long as the materials are relatively light in weight and have long useful lifetimes.

Finally, as shown in FIGS. 1, 2 and 7–9, each storage compartment 44, 60 and 68 will preferably include a handle 59, 67 and 80, respectively, which are especially useful for lifting the storage compartments 44, 60 and 68. Also, handles 59 and 67 may be used merely for opening top lids 46 and 62 respectively.

It is to be understood that numerous different shapes and sizes of storage compartments 40 may be used with the present invention, so long as any storage compartment used includes generally vertical compartment ribs on opposite sides thereof to engage box ribs 38 on transport box 12. For example, one can envision transportation of large numbers of long narrow objects such as rulers, which could be shipped in a plurality of storage compartments 40 having width dimensions approximately equal to the width of the rulers, depth dimensions approximately equal to the depth of the transport box 12 and height dimensions of anywhere between 1 and 15 inches, depending upon the number of rulers to be transported in each compartment. Of course, this should be understood to represent only a single example of the numerous different types of compartments which may be employed with the present invention, and is included to show that compartments may be designed which accommodate a variety of differently sized objects. One of the most important features of the present invention, therefore, is its ability to be modified to carry variously sized objects in compartments within the transport box 12, those compartments being secured within transport box 12 by interfitting ribs on the compartments and on the inner surfaces of transport box 12. Breakage of items within the transport container 10 is thus greatly reduced, as objects may only undergo limited shifting within compartments 40.

It is to be understood that numerous modifications, additions and substitutions may be made to the compartmentalized transport container 10 of the present invention. For example, the number, size and shape of the various storage compartments 40 may be modified to accommodate various sized objects. Also, the exact dimensions and construction materials used in the transport box may be modified to customize the transport box 12 for shipment of specific items. Finally, the shape of box ribs 38 and all compartment ribs on storage compartments 40 may be modified to have various cross-sectional shapes, such as triangular or rhomboid, depending on the shape of mold used to form the transport box 12 or compartments 40. Therefore, the scope of the present invention is not to be limited by the above disclosure, but rather shall be taken from the claims set forth below.

There has thus been set forth and described a compartmentalized transport container which accomplishes at least all of the stated objectives.

I claim:

1. A compartmentalized transport container comprising;

a generally rectangular transport box having two side walls, a front wall, a rear wall and a base wall, said side walls, said front and rear walls and said base wall connected along edges thereof such that an open-topped box is formed having outer and inner surfaces;

lid means for covering said transport box;

a plurality of generally upright box ribs on at least two of said side walls and said front and rear walls on said inner surface of said box, said box ribs extending generally perpendicular to said base wall of said box;

at least one generally rectangular storage compartment having two side walls, front and rear walls and a base wall, said side walls, said front and rear walls and said base wall connected along edges thereof such that said generally rectangular storage compartment is formed having outer and inner surfaces, said storage compartment being of a size and shape to fit within said box;

a plurality of generally upright compartment ribs on at least two of said side walls and said front and rear walls on said outer surface of said storage compartment, said compartment ribs extending generally perpendicular to said base wall of said storage compartment; and said compartment ribs interfitting with said box ribs such that said transport box slidably receives said storage compartment within said box, said storage compartment being restricted from substantial movement parallel with said box base wall due to said compartment ribs interfitting with said box ribs.

2. The transport container of claim 1 wherein said lid means comprises a generally rectangular top lid of a size and shape to completely cover said transport box, said top lid hingedly connected to said transport box such that said top lid may be pivoted away from said transport box to allow access to the interior of said transport box.

3. The transport container of claim 2 wherein said top lid further comprises a pin and hole securement system for releasably locking said top lid in a closed position on said transport box, said pin and hole securement system including at least one securement pin having a center longitudinal axis and extending outwards from said box lid into a pin receiving hole in said transport box, said pin movably mounted in said box lid such that said pin may be moved parallel with said center longitudinal axis of said pin, said pin and hole securement system further including a shaft rotatably mounted in said box lid and cable means extending between said pin and said shaft whereby rotation of said shaft initiates movement of said pin parallel with said center longitudinal axis of said pin whereby said pin is removed from said pin-receiving hole thereby releasing said box lid to allow said box lid to pivot relative to said transport box.

4. The transport container of claim 1 wherein said box ribs and said compartment ribs each comprise alternating grooves and ridges having a generally rectangular cross-sectional shape.

5. The transport container of claim 4 wherein said transport box includes said box ribs on each of said two side walls, said front wall and said rear wall, said box ribs extending from adjacent said base wall to the top edge of each of said side walls, said rear wall and said front wall.

6. The transport container of claim 4 wherein said generally rectangular storage compartment further comprises a lid hingedly mounted on said storage compartment whereby said lid completely covers and closes said storage compartment to prevent unintentional release of the contents of said storage compartment.

7. The transport container of claim 6 wherein said generally rectangular storage compartment comprises a vertical storage compartment adapted to store and retain a plurality of objects in generally upright alignment.

8. The transport container of claim 6 wherein said generally rectangular storage compartment comprises a horizontal storage compartment being of a size and shape to receive and store a plurality if objects aligned generally horizontally.

9. The transport container of claim 1 wherein said generally rectangular storage compartment further comprises at least one drawer slidably housed within said storage compartment such that access to said drawer is gained by sliding said drawer outwards from one of said side walls, said front wall and said rear wall.

10. The transport container of claim 1 wherein said compartment ribs on said storage compartment are formed on said front and said rear walls, said compartment ribs and said box ribs comprising alternating ridges and grooves having a generally rectangular cross-sectional shape such that said compartment ribs interfit with said box ribs upon placement of said storage compartment within said transport box.

11. The transport container of claim 10 wherein said storage compartment is of a size and shape such that said compartment ribs on said front and rear walls of said storage compartment interfit with said box ribs on said front and rear walls of said box whereby said storage compartment is restricted from substantial movement parallel with said box base wall.

* * * * *